United States Patent [19]

Martellotti

[11] Patent Number: 4,971,575

[45] Date of Patent: Nov. 20, 1990

[54] HIGH DENSITY CONNECTOR

[75] Inventor: James Martellotti, Tustin, Calif.

[73] Assignee: North American Specialties of California, Inc., Irvine, Calif.

[21] Appl. No.: 379,861

[22] Filed: Jul. 14, 1989

[51] Int. Cl.[5] ..... H01R 13/00

[52] U.S. Cl. ..... 439/496

[58] Field of Search ..... 439/492–499

[56] References Cited

U.S. PATENT DOCUMENTS

| | | | |
|---|---|---|---|
| 3,065,446 | 11/1962 | Robb et al. | 439/496 |
| 3,079,579 | 2/1963 | Cummins et al. | 439/496 |
| 3,082,398 | 3/1963 | Valach | 439/496 |
| 3,141,720 | 7/1964 | Johnson | 439/496 |

OTHER PUBLICATIONS

Article entitled "Electrically Actuated ZIF Connectors Use Shape Memory Alloys"–Connection Technology, Apr. 1987.

*Primary Examiner*—Joseph H. McGlynn
*Attorney, Agent, or Firm*—Darby & Darby

[57] ABSTRACT

A high-density connector arrangement for flat multi-conductor cables has a support housing, and flat cable support members held by the support housing. The cable supports may be organized in banks for increasing density of conductors, and are preferably releasably secured to the support housing. Contact between conductors on mating cable supports of two connectors is enhanced by providing resiliency of engagement, by causing the cable to arc outward or partially splitting the supports or providing a resilient layer arranged between the cable tape and its support.

23 Claims, 3 Drawing Sheets

FIG. 1
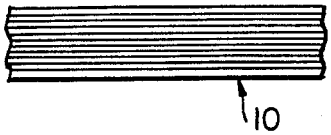
FIG. 1A
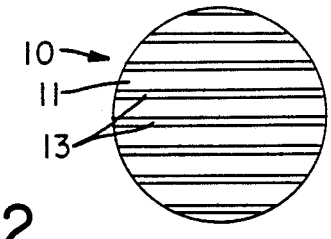
FIG. 2
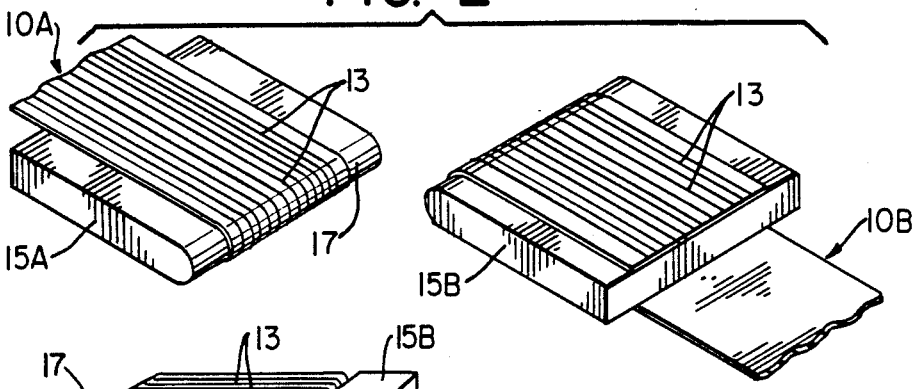
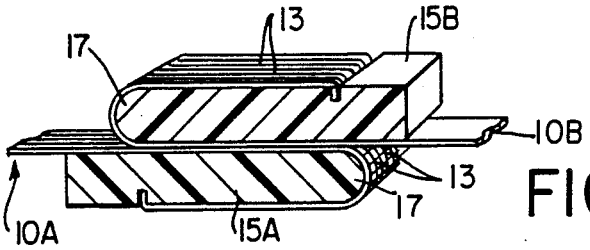
FIG. 3
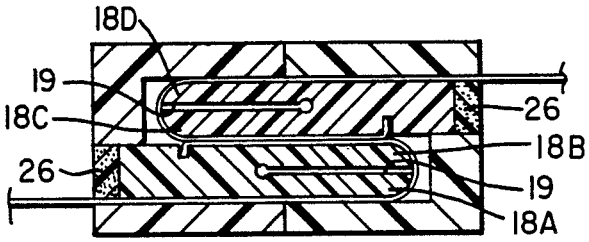
FIG. 4
FIG. 6
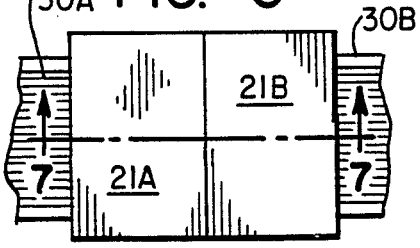
FIG. 10
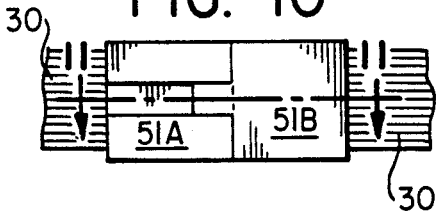
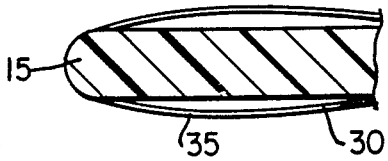
FIG. 15

HIGH DENSITY CONNECTOR

BACKGROUND OF THE INVENTION

The present invention relates to connectors for flat multi-conductor cables permitting a high density of conductors.

When using electronic, communication or data transfer networks in areas where space is limited, there is a need to utilize disconnectible connectors which are as compact as possible in order to accommodate an optimal number of conductors in the least amount of space. Some examples of areas where space is limited include aircraft, spacecraft, marine vessels, underground telephone distribution conduits, connectors for connecting compact circuits on printed circuit boards, integrated circuits, and various chips.

The number of conductors in connectors has traditionally been limited by the number of connectible contacts which can be accommodated in the connectors. Mated male (plug) and female (socket) connectors have a fixed number of contacts in the plugs and sockets which mate with each other. Due to structural and alignment requirements, the distance between adjacent contacts in the plugs or sockets is usually greater than the distance between adjacent conductors that are connected to the plugs or sockets.

The number of conductors which may be joined by a connector is therefore generally limited by the connector structure. It is desirable to have the connector highly compact while capable of joining many conductors.

It would therefore be desirable to provide a connector which can accommodate a high density of conductors and yet be more compact than prior plug and socket type connectors. It would further be desirable to have capacity available on connectors to accommodate future needs for increased number of conductors or circuits without being restrained by a space-limited low number of plugs and sockets or single row flat multi conductor type connectors.

SUMMARY OF THE INVENTION

The present invention is directed to a compact connector which accommodates a higher density of electrical conductors than can be accommodated in the same amount of space by connectors which effect connection by conventional plugs and sockets or by a connecting of a single flat multi-conductor cable.

One aspect of the invention resides in a connector having a support (which may be a housing) and a blade-like members held by the support. Cables, in the form of a tapes or strips, which have a plurality of conductors formed thereon, are wrapped around the outer surfaces of the blade members so that the conductors are accessible from outside of the support. The conducting paths on the flat cable or tape are discontinuous at or near the point where they wrap around the blades, so as to create separate electrical paths on each sides of said blades. Preferably either the conductor tape or the blade member is resilient.

A further aspect of the invention lies in having two connectors each with a support housing from which contains a bank of blade members, each blade member having flat cable with a plurality of conductors on its outer surfaces. The spacing between adjacent blade members is such that the blade members of each bank may intermesh with each other. When the blades are intermeshed, resilient contact is effected between respective conductors on the intermeshed members.

Resiliency in the conductor tape may be effected by forming it of a material that has a natural tendency to bow outward away from the outer surface of the blade member when wrapped around the free end of the blade. Resiliency in the blade member may be effected either by providing a conpressible resilient material as its outer surface or by splitting the blade longitudinally starting from its free edge for a predetermined distance so that the member is resilient at its free edge.

In one form of cable for interconnecting electrical or electronic units, a multiplicity of conductors are held in parallel relation in a flexible insulated strip or tape. The conductors may be embedded in the cable or formed as conductive films on the cable surface. Such cables may have their conductors joined at one end to respective circuits of a printed circuit board or electrical component, with the free other end to be joined to a similar cable connected to another circuit element. Such free cable ends are difficult to join together by conventional connectors because of the numerous conductors usually employed in the cable and their close spacing.

For a better understanding of the present invention, reference is made to the following description and accompanying drawings, while the scope of the invention is set forth in the appended claims.

BRIEF DESCRIPTION OF THE DRAWINGS

FIG. 1 shows a plan view of a general type of flat multi-conductor cable which may be used with the present invention.

FIG. 1A shows an enlarged fragmentary view of FIG. 1.

FIG. 2 shows a schematic perspective view of two generalized connector, blade members according to the invention, before coupling.

FIG. 3 shows a schematic perspective view of the blade members of FIG. 2 when coupled.

FIG. 4 shows a side view of a portion of a modification of the connector arrangement of FIG. 3.

FIG. 6 is a top view of the connectors of FIG. 5 with the two connectors joined.

FIG. 10 is a side elevational view of the connectors of FIG. 9 joined together.

FIG. 15 is a side elevational cross-sectional view of still another modified blade-like member useful in the invention.

DESCRIPTION OF THE PREFERRED EMBODIMENTS

FIG. 1 shows generally a plan view of a type of flexible cable or "flex circuit" 10 to which the present invention is applicable. FIG. 1A shows an enlarged fragmentary view of flex circuit or cable 10. It comprises a tape or strip 11 of flexible insulating material on which are formed (as by printing, lamination, embedding etc.) a series of parallel conductors in the form of conductive lines or stripes 13. By way of example, such conductors may be 5 mils (thousandths of an inch) wide and spaced to be 100 to the inch (i.e. with a pitch of 10 mils). As can be readily appreciated, to connect two such flex circuits so that each of the conductors of one circuit is connected to (and only to) a respective conductor of a cooperating flex circuit offers considerable difficulty, which the present invention overcomes.

According to a feature of the present invention, a flex circuit cable 10A or 10B is bent around a respective flat rigid or slightly flexible, blade-like cable-supporting member 15A, 15B as seen in FIGS. 2 and 3. The flex circuit 10A or 10B has discontinuous conductors at or near the point where they are wrapped around the blades 15A or 15B, the conductors end, thus creating separate electrical paths on each side of the blade members. The conductors 13 on the portion of each cable overlying the support member face outwardly from the support member and are exposed, either in fabricating each cable, or by suitably removing any overlying insulation. Accordingly, when the support members 15A, 15B with their assembled flex cables 10A, 10B are engaged together as in FIG. 3, with their respective conductors 13 in registry, electrical connection will be made simultaneously for all the conductors of one flex cable to the respective conductors of the other flex cable.

Figure 14:
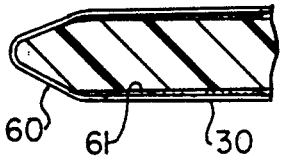
FIG. 14 is a side elevational cross-sectional view of another modified blade-like member useful in the invention.

It will be understood that a suitable support or housing is provided for holding a support member assembled with its flex cable to form a connector, adapted to be coupled to a similar connector having a housing holding its cable support member, with the conductors positioned by the housing to be in cooperating registry with the first connector, as seen in FIG. 4. Each support member is preferably formed with a rounded nose or front edge 17 as seen in FIGS. 2–4, or a modified tapered configuration, as seen in FIG. 14, to facilitate engaging one connector with another.

It will be understood that the material for the support members may be made resiliently flexible (such as a foam-like or elastomeric material) so that on joining two connectors, the support members are slightly compressed, to provide a resilient force to hold the respective conductors in good contact. Alternatively, the support members 15 may be substantially rigid (of insulating or metallic material) with each member provided with a slot 19 extending inward from its nose 17, as shown in FIG. 4, so as to make each pair of legs 18A, 18B and 18C, 18D of the respective support member slightly yieldable upon mating of the two connectors, and providing a resiliency urging the engaged legs 18B, 18C toward one another to enhance the electrical connection of the respective conductors carried by the support members.

Figure 9:
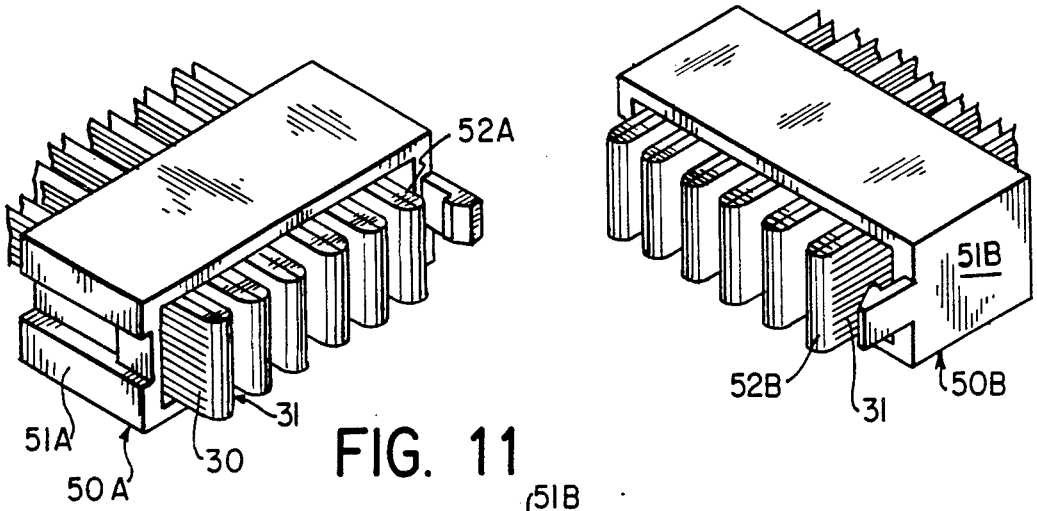
FIG. 9 is a perspective view of another embodiment of the present invention showing two joinable connectors in separated relation.
Figure 11:
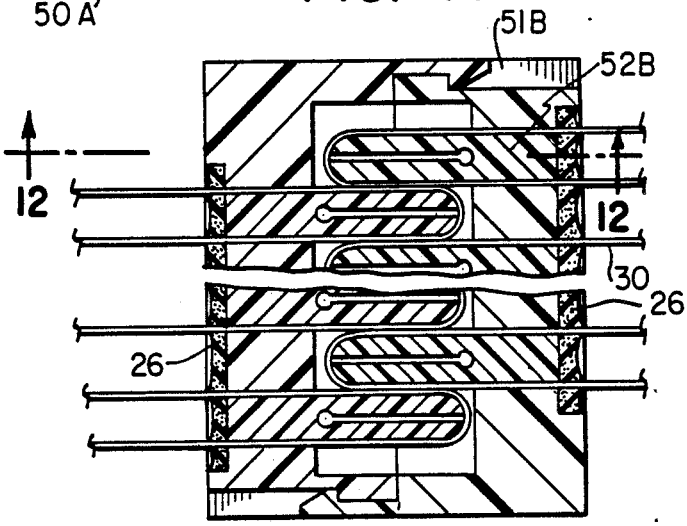
FIG. 11 is a cross-sectional view taken across section line 11—11 of FIG. 10.

The connectors thus described are limited as to the number of possible connections only by the maximum connector width feasible, and the width and pitch of the conductors 13 on the flex cable 10, and by the number of cables connected in a bank of cable supports as in FIg. 9 and FIG. 11. The present invention provides for a further increase in the density of conductors which may be simultaneously joined by connectors.

FIGS. 5–8 show a form of the invention having two connectors 20A, 20B which join two separate flex circuits simultaneously. Each connector 20A, 20B has a respective support housing 21A, 21B.

Protruding through an open face 25A of support housing 21A is a cable support member 22. Protruding through an open face 25B of support housing 21B are two cable support members 23, 24. Each cable support member may be cemented or otherwise permanently secured to its respective support housing by cement or epoxy 26 (see FIG. 7). Wrapped around each cable support member is a flex cable 30. On each cable 30 are a multiplicity of parallel conductors 31, suitably formed on the surface of the cable 30. The flex cable 30 extends through an opening in the backwall (or epoxy 26) of the support housing.

Figure 7:
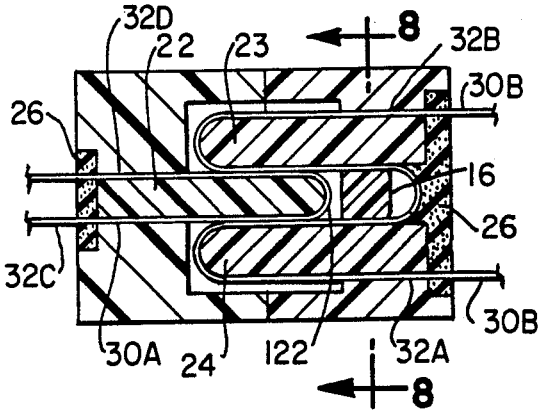
FIG. 7 is a cross-sectional view of the joined connectors taken across section line 7—7 of FIG. 6.

The outside surface of each support housing 21A, 21B has a means for holding the two housings mated together, such as a releasable latch mechanism including a latch extension 40 and slot 41 which are engageable with counterparts on the mating support housing. The latch extension 40 has a catch 42 which engages a ledge 43. The support housings of the two connectors 20A, 20B are formed such that their respective cable support members 22, 23, 24 intermesh with each other as shown in FIG. 7, with the conductors 31 on one cable 30A in contact with respective conductors 31 on the other cable 30B when the catch 42 snaps into a locking position against the ledge 43. Catch 42 is resilient and can be bent outward so as to be released from the ledge 43.

Figure 8:
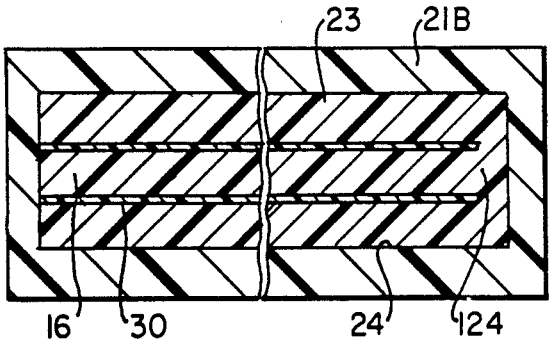
FIG. 8 is a cross-sectional view of the joined connectors of FIG. 5 taken across section line 8—8 of FIG. 7.

As shown in FIG. 7, flex cable 30B of connector 20B is wrapped around both support members 23 and 24, and may be wrapped around a post 16 formed either as part of the support housing 21 between the spaces for the two support members 23, 24 or integrally with the members 23,24 as at 124 in FIG. 8. The conductors 31 of one section 32A of a cable 30B are isolated from those of another section 32B of cable 30B, by being interrupted and made discontinuous at a position between cable sections, such as at the post 16. Similarly, flex cable 30A of the mating connector 20A has its conductors interrupted, as at the nose or edge of the support member 22, to form two separate flex circuit sections 32C, 32D.

Contact between conductors 31 of the flex cables 30 on the intermeshed cable support members 22, 23, 24 is desirably effected resiliently to ensure good contact. This resiliency is obtained in the manner described above or in any other suitable manner. For instance, as is shown in greater detail in FIG. 11, the tape 30 may be flexibly resilient so that it bows away from the surface of the support 15. This bowing effect arches the tape 30 causing it to have a portion 35 spaced away from the outside surface of the support 15. The supports 15 are arranged relative to each other so that when intermeshing the supports 15 in a like manner to the intermeshing of cable support members 22, 23, 24 of FIG. 7, the arched portions 35 press against each other, creating resilient contact between the respective conductors 31 on tapes 30 of the intermeshed supports 15.

Thus, this form of the invention increases the conductor density of the connectors by joining two pairs of flex circuits simultaneously, in a space barely greater than that needed for joining one pair of circuits.

Figure 12:
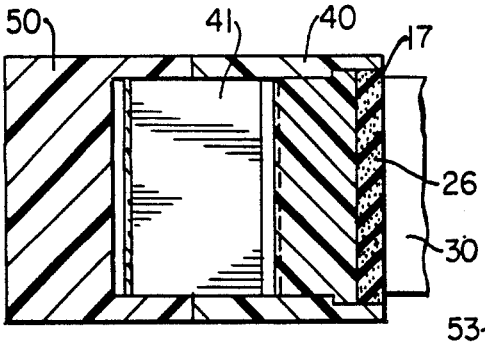
FIG. 12 is a cross-sectional view taken across section line 12—12 of FIG. 11.
Figure 13:
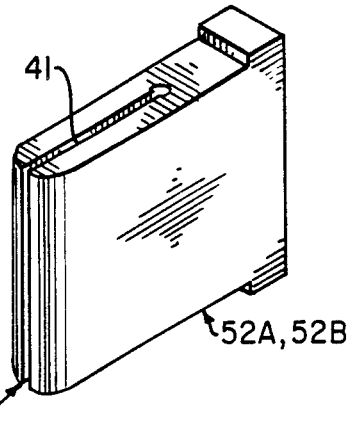
FIG. 13 is a perspective view of a modified form of blade-like member which may be used in any of the embodiments of the invention.

FIGS. 9–12 show another embodiment of the invention with connectors 50A, 50B having a releasable clamping mechanism that operates the same as for the previous embodiment. This embodiment differs from the previous embodiment by having a bank of cable supports 52A, 52B in the respective support housing 51A, 51B which are oriented perpendicular to the orientation of the cable support members 22, 23, 24 in housing 21A, 21B of the embodiment of FIGS. 5–8. Further, each of the cable supports 52A, 52B is partially longitudinally split inwardly from its free edge so as to define a clearance 53 defined by sidewalls 52 (see FIG. 13). This split provides resiliency in that the sidewalls 52 can be pressed or bent toward each other resiliently within at least some part of the clearance 53. When intermeshed as shown in FIG. 11, the intermeshed cable supports 52A, 52B press against each other ensuring contact between the conductors 31 of intermeshed cables 30.

The resiliency techniques for ensuring good contact by the conductors as discussed above are interchangeable, and can be used separately or in combination with one another.

Another way to achieve resiliency is shown in FIG. 14. A compressible elastic material 61 is arranged between the flex cable 30 and the support 60. When two connectors are brought together so that the supports are in an intermeshing relationship, the elastic material 61 compresses under pressure from the intermeshing supports. Good contact between the conductors is assured due to the resiliency of the elastic material 61. This elastic material 61 can be applied to the embodiments described above either as a replacement for, or in combination with, the previously mentioned resiliency techniques.

Figure 5:
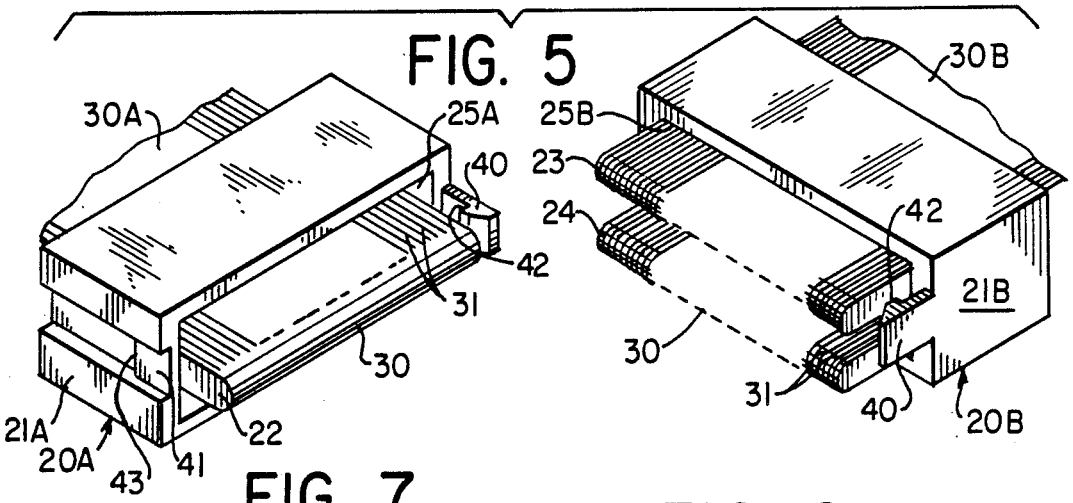
FIG. 5 is a schematic perspective view of a modification of the present invention showing two joinable connectors in separated relation.

It should also be understood that the embodiment of FIGS. 5–8 may be modified to employ a bank of supports 15 in a manner similar to that of the embodiment of FIG. 9, with additional supports 15 oriented parallel to supports 15 of FIG. 5.

It will be understood that the cable supports 15 of any of the embodiments of the invention may either be permanently fixed to the support housing (e.g. by cementing as in FIGS. 7,11) or releasably held in position by suitable means.

As can be seen in FIGS. 9–12, the two connectors for a coupling may be made to be identical to each other, and do not need to be specially formed to be strictly male or female in configuration. Where the cable supports are releasably held in the support housing, they can be quickly repositioned which therefore facilitates interchangeability at a site installation.

It is desirable that the cable supports 15 be flush against the sidewalls of the support housing, and preferably parallel to each other, so as to ensure that the location of the conductors can be predetermined for alignment of the conductors during intermeshing of the cable supports. The width of the conductors and spacing therebetween will naturally take into consideration alignment tolerances.

Figure 16:
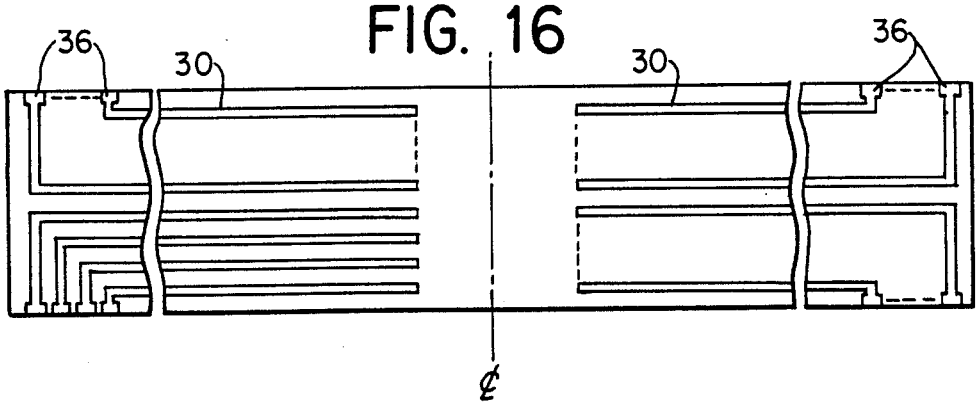
FIG. 16 is a plan view of a portion of a form of flexible cable tape or strip usable in the invention.

The parallel conductors 13 on the tape 30 may extend longitudinally on the tape 30 but may change direction to extend transversely until terminating at terminal ends 36 as shown in FIG. 16. The spacing between adjacent conductors as they extend transversely may be greater than the spacing between adjacent conductors as they extend longitudinally. The terminal ends themselves may be widened to facilitate their connection with external connectors.

While the foregoing description and drawings represent preferred embodiments of the present invention, it will be understood that various changes and modifications may be made without departing from the spirit and scope of the present invention, as defined by the appended claims.

What is claimed is:

1. A connector arrangement for flat multiconductor cables having a multiplicity of conductors thereon, comprising:

a support housing;

a flat blade-like cable-support member mounted in said support housing and having a free edge at the front thereof, and a cable wrapped around the edge of said member and having conductors exposed and adapted to engage corresponding conductors of a like arrangement, said cable having two cable sections each with exposed conductors, each face of said member having a respective one of said cable sections thereon, the conductors on one of said cable sections being disconnected from the conductors on the other of said cable sections so that said cable sections are adapted to function independently of each other, and so that said connector arrangement is adapted to connect more circuits than there are conductors on either section of said cable.

2. A connector arrangement as in claim , further comprising:

a plurality of blade-like cable-support members each having a free edge wrapped around by a respective cable that has a plurality of conductors, each conductor of each said cable having a gap at said free edge.

3. A connector arrangement as in claim 1, wherein said blade-like member is split longitudinally and inwardly from the free edge thereof for a predetermined distance so as to provide sidewalls defining said split, said side walls being resiliently squeezable toward each other under transverse pressure adjacent said free edge.

4. A connector arrangement as in claim 1, wherein said cable is resiliently flexible and is bowed outward away from said member away from said free edge.

5. A connector arrangement as in claim 1, comprising compressible resilient material between said member and said

6. A connector arrangement as in claim 1, wherein said blade-like member is of insulating material.

7. A connector arrangement as in claim 1, further comprising:

means for releasably holding said blade-like member in said support housing.

8. A connector arrangement as in claim 1, further comprising:

means for fixing said blade-like member to said support housing.

9. A connector arrangement as in claim 1, wherein said flat blade-like cable-support member has an outer surface area which is flat and against which is wrapped said cable, said outer surface area being on a side of said flat blade-like cable-support member which is to face a corresponding flat blade-like cable-support member of said like arrangement, said outer surface area extending from said free edge at said front to a distance which is as far as a like free edge of said corresponding flat blade-like cable-support member may reach upon completion of said engagement, said outer surface area being free of any projection extending outward that is closer to said cable than is a remainder of said outer surface area.

10. A connector arrangement as in claim 1, wherein said support housing has means for resiliently securing said support housing to a corresponding support housing of said like arrangement simultaneously upon completion of engagement of said conductors with said corresponding conductors of said like arrangement, said resiliently securing means maintaining contact between said support housing and said corresponding support housing of said like arrangement and ensuring alignment of said conductors with said corresponding conductors of said like arrangement while said contact is maintained, said resiliently securing means being responsive to a relative movement of said support housings toward each other for biasing into a locking position upon said completion.

11. A coupling for two flat multi-conductor cables each having a multiplicity of parallel equally spaced conductors thereon, comprising:

a pair of connector arrangements each with a respective support housing that has an open side, each of said connector arrangements having a blade-like cable-support member held by said respective support housing and extending toward said open side thereof, each of said members having an outside surface, each of said connector arrangements having a respective flat cable with a respective set of parallel conductors exposed above said outside surface, said members having an intermeshing arrangement for placing the conductors of one cable into contact with respective conductors of the other cable, each of said support housings having means for resiliently securing together each other simultaneously upon completion of engagement of said conductors of said one cable into contact with said respective conductors of the other cable, said resiliently securing means maintaining contact between each of said support housings and ensuring alignment of said conductors and said respective conductors with each other, said resiliently securing means being responsive to a relative movement of said support housings toward each other for biasing into a locking position upon said completion.

12. A coupling as in claim 11, wherein each of said flat blade-like cable-support members have a respective outer surface area which are on respective sides of said flat blade-like cable-support members which face each other, said conductors of said cables being in contact with each other between said outer surface areas only, said outer surface areas being free of any projections extending outward that is closer to said contact than is a remainder of said outer surface areas.

13. A coupling arrangement as in claim 11, wherein said cable has two cable sections each with exposed conductors, each face of said member having a respective one of said cable sections thereon, the conductors on one of said cable sections being disconnected from the conductors on the other of said cable sections so that said cable sections are adapted to function independently of each other, and so that said connector arrangement is adapted to connect more circuits than there are conductors on either section of said cable.

14. A coupling arrangement for flat multi-conductor cables having a multiplicity of conductors thereon, comprising:

a first connector having a first flat blade-like cable-support member and a first such cable with first conductors thereon, said first cable being wrapped about a portion of said first cable-support member so that said first conductors face outward; and a second connector having a second blade-like cable-support member and a second cable with second conductors thereon, said second cable being wrapped about a portion of said second cable-support member so that said second conductors face outward, said first and second members engaging each other so that said first conductors and second conductors are respectively in contact with each other between said first and second members, said first and second members each having a respective area facing each other between which said contact is made of said first and second conductors, each of said areas being free of any outward projection that is closer to said contact than is a remainder of said areas.

15. A coupling arrangement as in claim 14, further comprising:

a support housing each of said cable-support members; and means for releasably securing each of said members to its support housing.

16. A coupling arrangement as in claim 14; further comprising:

means for resiliently securing said first and second connectors together simultaneously upon completion of engagement of said first and second conductors with each other, said resiliently securing means maintaining contact between said first and second connectors and ensuring alignment of said first and second conductors with each other, said resiliently securing means being responsive to a relative movement of said connectors toward each other for biasing into a locking position upon said completion.

17. A coupling arrangement as in claim 14, further comprising:

means for resiliently holding said first and second conductors against each other while said first and second members are engaged with each other.

18. A coupling arrangement as in claim 17, wherein said resiliently holding means includes said cables being resilient.

19. A coupling arrangement as in claim 17, wherein said resiliently holding means includes a longitudinal split in each of said cable-support members extending from respective free edge of said members so that said members are resiliently compressible against each other at said free edges.

20. A coupling arrangement as in claim 17, wherein said resiliently holding means includes a compressible resilient element on said member adapted to press each member against said cables.

21. A coupling arrangement for flat cables having a multiplicity of conductors thereon, comprising a first connector having a first support housing and a first flat blade-like cable-support member supported in said housing with a tapered front edge in an opening in said housing, with one such cable wrapped around said front edge and having said cable substantially flat against both faces of said member and with said conductors facing away from the faces of said members; and a second connector having a second support housing and a pair of additional flat blade-like members supported in said housing, each with a tapered front edge in an opening in said second housing, with a second cable wrapped continuously around the front edges of said additional members and with the conductors of said second cable on a face of each of said additional members facing each other, said first member being insertable between said pair of additional members so that a set of conductors on one face of said first member engages a set of conductors on one of said pair of members and a set of conductors on the other face of said first member engages a set of conductors on the other pair of members.

22. A coupling arrangement as in claim 21 wherein the conductors of said first cable on one face of said first member are disconnected from the conductors on the other face of said first member so as to thereby form two separate cable sections of said first cable, and the conductors of said second cable on a face of one of said pair of additional members are disconnected from the conductors of said second cable on a face of the other of said pair of members so as to thereby form two separate sections of said second cable, each section of the first cable being separately connected to a respective section of said second cable by engaging said first member between said pair of additional members.

23. A coupling arrangement as in claim 21, wherein said cable has two cable sections each with exposed conductors, each face of said member having a respective one of said cable sections thereon, the conductors on one of said cable sections being disconnected from the conductors on the other of said cable sections so that said cable sections are adapted to function independently of each other, and so that said connector arrangement is adapted to connect more circuits than there are conductors on either section of said cable.

* * * * *